United States Patent [19]

Gaa et al.

[11] Patent Number: 4,708,116

[45] Date of Patent: Nov. 24, 1987

[54] INJECTION SYSTEM FOR A DIESEL ENGINE WITH A HIGH PRESSURE INJECTION PUMP FOR EACH CYLINDER

[75] Inventors: Roland Gaa, Möglingen; Richard Kinzel, Stuttgart/Feurbach, both of Fed. Rep. of Germany

[73] Assignee: Motoren-Werke Mannheim Aktiengesellschaft, Mannheim, Fed. Rep. of Germany

[21] Appl. No.: 830,951

[22] Filed: Feb. 19, 1986

[30] Foreign Application Priority Data

Feb. 23, 1985 [DE] Fed. Rep. of Germany ..... 3506392

[51] Int. Cl.[4] ..... F02M 39/00

[52] U.S. Cl. ..... 123/506; 123/300

[58] Field of Search ..... 123/506, 500, 501, 299, 123/309, 458

[56] References Cited

U.S. PATENT DOCUMENTS

| | | | |
|---|---|---|---|
| 3,779,225 | 12/1973 | Watson | 123/506 |
| 4,033,301 | 7/1977 | Walton | 123/300 |
| 4,033,314 | 7/1977 | Walton | 123/299 |
| 4,132,201 | 1/1979 | Bart | 123/299 |
| 4,175,587 | 11/1979 | Chadwick | 123/300 |
| 4,389,098 | 9/1981 | Norberg | 123/300 |
| 4,395,987 | 8/1983 | Kobayashi | 123/506 |
| 4,489,697 | 12/1984 | Kawatei | 123/506 |
| 4,510,908 | 4/1985 | Eisele | 123/506 |
| 4,612,893 | 9/1986 | Ishibashi | 123/506 |
| 4,619,239 | 10/1986 | Wallenfang | 123/506 |

*Primary Examiner*—Carl Stuart Miller

*Attorney, Agent, or Firm*—Charles L. Schwab

[57] ABSTRACT

An injection system for a diesel engine with an injection pump for each cylinder has a delivery control valve 16 which is subjected to hydraulic control commands from a single central servohydraulic system, so that the respective spool 39 of the delivery control valve 16 connects the high pressure pump chamber 35 of the injection pump with its supply chamber 36. This bypassing connection occurs simultaneously in all the delivery control valves 16, however, movement of the delivery control spool 39 to a more fully open position takes place only if the associated injection pump is delivering fuel to the nozzle because the delivery pressure is used to complete the opening movement of the delivery control valve spool 39. In addition, a similarly operated pilot injection valve 60 is provided.

18 Claims, 5 Drawing Figures

INJECTION SYSTEM FOR A DIESEL ENGINE WITH A HIGH PRESSURE INJECTION PUMP FOR EACH CYLINDER

BACKGROUND OF THE INVENTION

The increasing demands being made that diesel engines be operationally safe, economical and compatible with the environment are necessitating use of injection systems which are increasingly costly. It has been shown that only minimal advantages can be gained with respect to the before-mentioned requirements when using diesel engines with conventional injection systems. Research which has been carried out in the last several years has, therefore, been aimed at developing a high pressure injection system having marked improvement in the operating characteristics of a diesel engine. In particular, additional and more significant improvements with respect to the before-mentioned requirements are to be expected whenever the initiation of injection, the amount of fuel injected and pilot injection can be optimized for each operating level of the diesel engine.

It is known that a preliminary or pilot injection can be produced by interrupting the injection process by short-term emptying of the high pressure pump chamber of the injection pump. During this interruption, the fuel pressurized by movement of the pump piston of the injection pump is routed to an equalizing chamber in which there is an equalization piston which is biased by means of pressure which can be varied depending on speed. This prior system does not provide for a complete separation of fuel and the hydraulic fluid of the additional pressure system.

OBJECTS AND BRIEF SUMMARY OF THE INVENTION

It is an object of this invention to provide an injection system which meets the hereinbefore mentioned requirements in such a way that the injection amount can be easily controlled.

This objective is met in the present invention by provision of a fuel delivery control device or valve for each of the individual cylinder injection pumps wherein the devices are all controlled by a single servohydraulic system functioning in a controlled or programmed manner. The fuel delivery control valve includes a delivery control spool which moves to connect the high pressure pump chamber of the injection pump with its suction chamber. This connection is under the control of a solenoid valve in the servohydraulic system which simultaneously subjects all the control devices to a change of hydraulic pressure. However, the delivery control devices are designed so that only the one associated with the injection pump delivering fuel to its injector will be moved to a completely open position for bypassing pressurized fuel to the supply chamber of the injection pump. The solenoid valve is shifted in a timed manner to open the delivery control bypass of the pump during fuel delivery to pump pressurized fuel from the pressure chamber to the supply chamber and cause a cessation of fuel delivery by the injection nozzle. Preferably, the delivery control device is actuated by a release of pressure in the servohydraulic system. The quantity of fuel delivered is determined by regulating the timing of the pressure drop in the servohydraulic system. Regulation of the solenoid valve can be accomplished by an electronic regulator, the set values for which are specified by the control panel, and for which the actual values are determined by electronic needle stroke monitors at the respective nozzle holder assemblies. Additional engine operating values, such as speed, load, and so forth can be considered. Smoke optimization during acceleration can be achieved by means of an induction pressure dependent increase in the injection quantity during the process of acceleration. The exhaust gas temperature and ignition compression can be reduced to a minimum. The injection quantities can be reduced at certain cylinders to a cylinder nonignition condition. The injection quantity can be controlled, depending on fuel temperature and type of fuel. Initiation of fuel delivery can be regulated in the usual way by a control bar and a diagonal leading edge on the end of the pump piston. Actuation of the pump control rod can be accomplished by an electrically operated actuator controlled by the electronic regulator. In this way, initiation of fuel delivery as well as the delivery duration can be precisely regulated. Since the fuel circuit is completely separated from the servocircuit, this invention can also be utilized when using heavy oil as fuel.

The pilot injection control means of this invention may be used in a fuel injection system having a delivery control of the type hereinbefore described or it may be used separately. The pilot injection valve components have been designed to be similar to those of the delivery control valve. The significant difference between them lies in the fact that in order to interrupt fuel injection to effect a pilot injection and then a main injection during the delivery stroke of the injection pump piston, a small quantity of fuel is diverted to an equalizing chamber to interrupt fuel delivery and returned from the equalizing chamber to the high pressure pump chamber of the injection pump after the delivery stroke has been completed. In both fuel delivery modifying systems 16, 60, there is complete separation of the fuel circuit and the servocircuit.

BRIEF DESCRIPTION OF THE DRAWINGS

The invention is illustrated in the drawings in which.

DETAILED DESCRIPTION OF THE DRAWINGS

Figure 1:
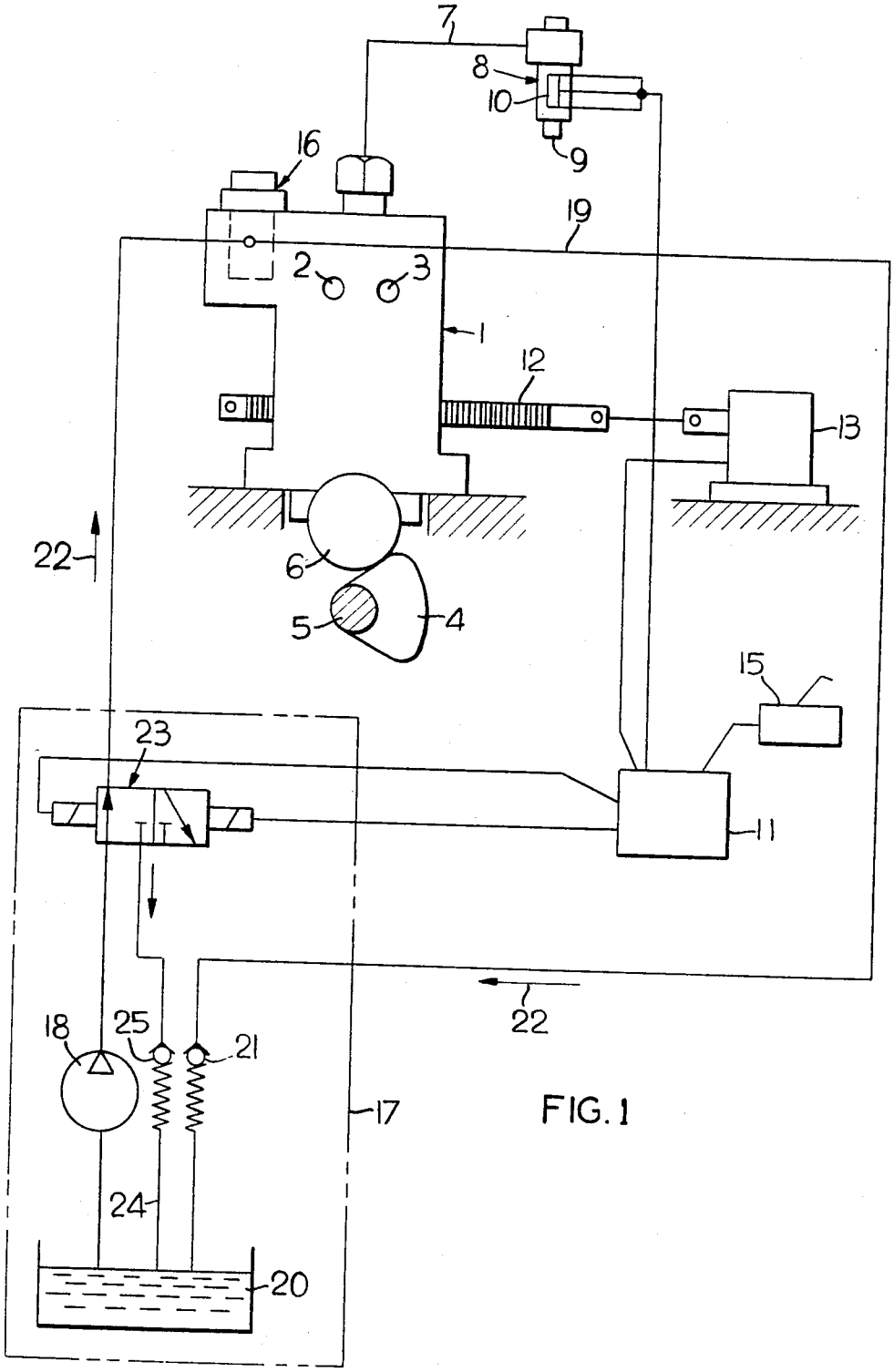
FIG. 1 is a schematic illustration showing an injection system in which an injection pump is provided with its individual delivery control valve.

Referring to FIG. 1, diesel fuel is supplied from the fuel tank, not shown, by a supply pump, not shown, to intake port 2 of an injection pump 1 for a cylinder of a diesel engine, not shown. The unused or excess fuel is returned to the fuel tank, not shown, via return port 3. All of the injection pumps of an engine are connected to the fuel lines connected to these ports 2 and 3. The high injection pressure which originates in injection pump 1 is created by means of a drive cam 4 of cam shaft 5 acting against a roller actuator 6. The fuel which is delivered by injection pump 1 is conveyed by high pressure line 7 to a nozzle holder assembly or injector 8, which is secured to a combustion cylinder of the engine, not shown. The fuel is injected into the cylinder by a nozzle 9 of the injector 8. A needle stroke monitor 10 is attached to the injector 8, which transmits in digital form a signal which corresponds to the stroke of the nozzle needle valve, not shown, to an electronic regulator 11. Through use of this needle stroke monitor 10, the needle stroke and thus the beginning and concluding points of the injection are determined.

The beginning of fuel delivery by the injection pump 1 is controlled by control rod 12, which is connected to and positioned by an electrical linear actuator or positioner 13. The positioner 13 receives its commands from the electronic regulator 11, which compares the mean values of all digitalized injection-begin signals with stored injection-begin reference values and makes corrections accordingly. The respective injection-begin signals are transmitted by the monitor 10 at the beginning of the needle stroke. The respective injection-begin reference values are stored depending on load and speed, whereby optimal regulation of each level of engine operation is possible. The electronic regulator 11 receives its command as to speed and/or load settings from control panel 15.

In addition, a delivery control device in the form of a delivery control valve 16 is attached to the injection pump 1, by means of which the end of the injection process is determined. The delivery control valve 16, together with the rod control 12 controlling the beginning of injection, determines the quantity of fuel delivered to the cylinder by the injector 8. A single servohydraulic system 17 is provided for all delivery control valves 16 of all the injection pumps 1 of an engine. The servohydraulic system includes a hydraulic pump 18, which supplies all the delivery control valves 16 of all of the injection pumps 1 of the engine with pressure fluid from a storage tank 20 via a fluid pressure conduit 19. A pressure regulating valve 21, which determines a relatively high pressure in the conduit 19, is provided in the fluid pressure conduit 19 at the supply tank 20. The direction of fluid flow in the conduit 19 is indicated by arrows 22. An electrically operated control valve in the form of a solenoid valve 23 is included in the hydraulic or servopressure system 17 which is disposed in the conduit 19 between the pump 18 and the first delivery control valve 16. The solenoid valve may be operated to discharge the fluid in the conduit 19 to the supply tank 20 by way of a return line 24 having a low pressure valve 25. The solenoid valve 23 is controlled by the electronic regulator 11.

Figure 2:
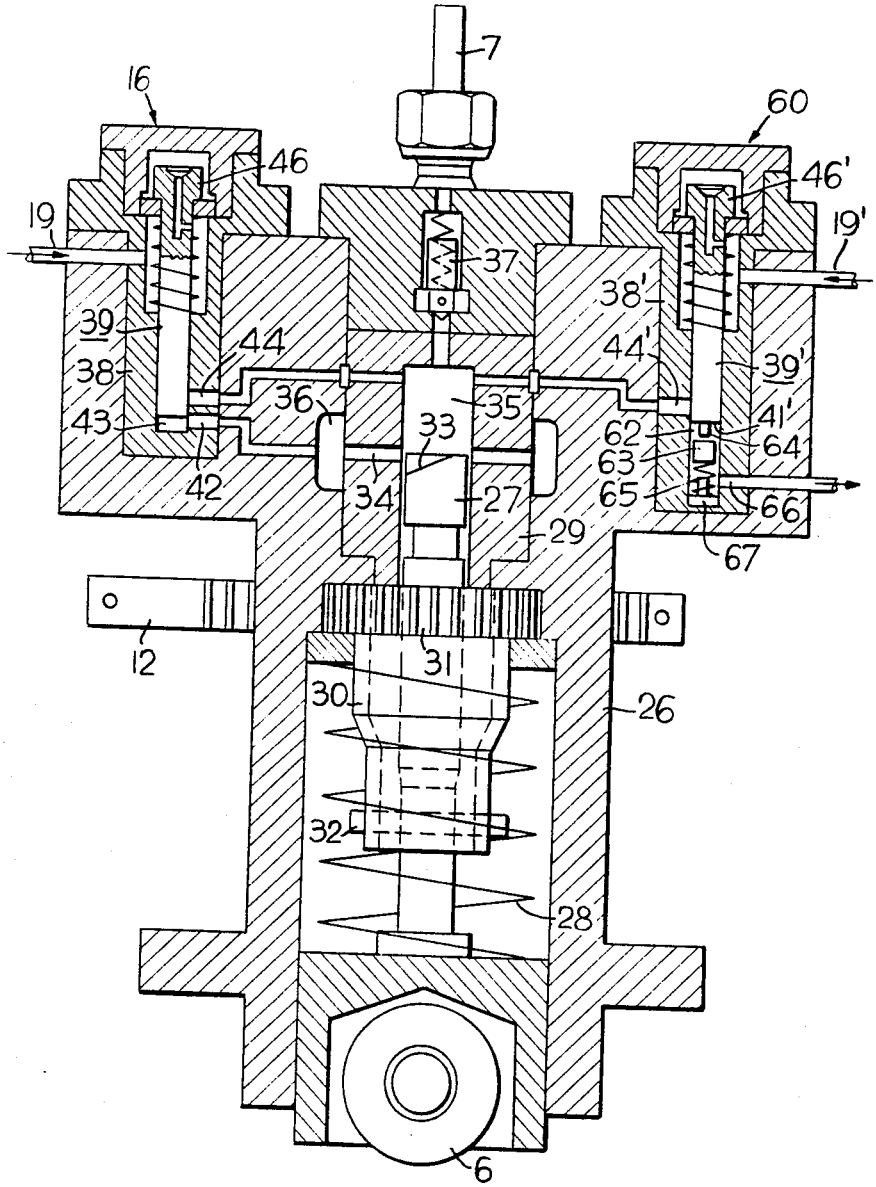
FIG. 2 is a vertical section through the injection pump, which is provided with a delivery control valve and a pilot injection valve.

As is illustrated in FIG. 2, a pump piston 27 is disposed within the housing 26 of the injection pump 1 which, during operation, is moved by the roller actuator 6 against the opposing force of a prestressed compression spring 28. The displacement pump piston 27 is supported within a cylinder 29 which is arranged within the housing 26; the piston 27 is surrounded by a rotatable sleeve 30 having an external gear 31. The teeth of the external gear 31 meash with teeth on a rack portion of the control rod 12. The rotatable sleeve 30 is connected to the reciprocating pump piston 27 by means of a nonrotatable sliding coupling 32, so that the pump piston 27 may be rotated by longitudinal movement of the control rod 12.

The pump piston 27 conventionally has a diagonal leading edge 33 along its upper or pumping end which is opposite the roller actuator 6. In its lower retracted position, in which drive cam 4 does not engage the roller actuator 6, the pump piston 27 is positioned below intake openings 34, which connect a high pressure pump chamber 35 with a supply chamber 36. The suction chamber 36 is connected constantly with an intake port 2 and a return port 3, so that the supply chamber 36 is continuously filled with fuel.

Upon displacement of the roller actuator 6 by the camming action of the drive cam 4, the pump piston 27 moves upwardly closing the intake openings 34 and pressurizes the fuel in high pressure pump chamber 35 to a delivery pressure whereupon it is delivered through the high pressure line 7 to the injector 8 and, thus, to its nozzle. 9. The monitor 10 responds at this point and transmits a signal to the regulator 11 to indicate the beginning of the injection. The intake openings 34 are first covered as the diagonal edge 33 moves across them and when completely closed, delivery pressure is established and injection begins. Movement of the control rod 12 changes the beginning of fuel delivery (injection). A spring biased one-way valve 37 is positioned between the high pressure pump chamber 35 and the high pressure line 7.

The features of the injection pump 1 described in detail to this point are of conventional construction.

Figure 3:
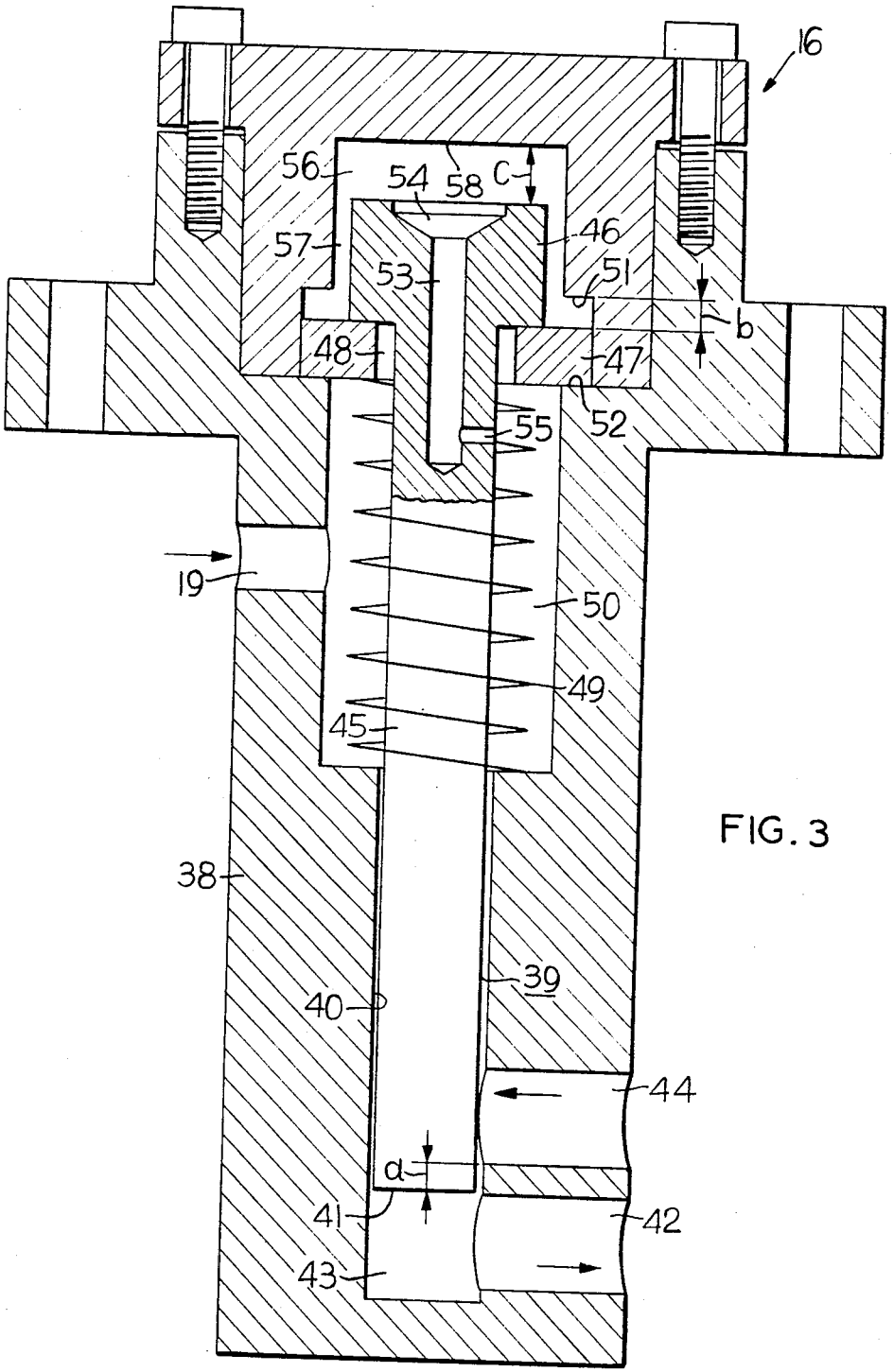
FIG. 3 is a vertical section through the delivery control valve shown in FIG. 2.

FIG. 2 shows the delivery control means or valve 16, which is shown in greater detail in FIG. 3. The delivery control valve 16 includes a casing 38, which is positioned within the housing 26 of the injection pump 1. Within the valve casing 38, an axially shiftable slide valve element or delivery control spool 39 is in fluid sealed relation with a cylindrical bore 40. Below the lower end surface or area 41 of the axially shiftable spool 39, a low pressure passage 42 places a low pressure chamber 43 in free-flow fluid communication with the fuel supply chamber 36 of the injection pump 1. Thus, the lower end surface 41 and the casing bore 40 define the low pressure chamber 43 in which the fuel is at the same low pressure as maintained in the supply chamber 36 by a supply pump, not shown, connected to the intake port 2. The spool 39 is biased upwardly by the low pressure fuel acting against the pressure area 41 of the spool 39. Whenever the spool 39 is moved from its illustrated fluid flow control position a predetermined axial overlap stroke a, its lower end surface 41 will be adjacent the lower edge of a high pressure passage 44, which is connected in free-flow fluid communication with the high pressure pump chamber 35 at a point above the maximum stroke of pump piston 27. The high pressure passage 44 is always subject to the pressure of the pump pressure chamber 35. The delivery control spool 39 is provided with a rod portion 45 extending upwardly from its end area 41, at the end of which there is a radially extending stop ring flange 46. A stroke limit disk 47 is adjacent to the stop ring flange 46 and has a central axial opening 48 through which the rod portion 45 of the spool 39 extends with adequate radial clearance. A resilient coil compression spring 49 surrounds the rod portion 45 of the spool 39 within a servopressure chamber 50 within the casing 38. The lower end of the spring 49 is in thrust transmitting engagement with a bottom wall of the wall means defining the servopressure chamber 50 and the upper end of the spring is in upward axial thrust transmitting engagement with the stroke disk 47. The fluid pressure conduit 19 of the servohydraulic system 17 supplies pressure fluid to the servopressure chamber 50. Stroke limit disk 47 is free to move between axially spaced parallel wall surfaces 51, 52 of the casing 38. The distance b, which is the axial spacing of the abutment surfaces 51, 52 minus the axial thickness of the stroke limit disk 47, is the spring stroke b of compression spring 49. Spring stroke b is greater than overlap stroke a and, thus, when the spool 39 moves through stroke b to its partially open position, the high pressure passage 44 will be partially open at the bore 40.

The stop ring flange 46 is provided with a central blind hole or bore 53, which extends inwardly from a funnel portion 54. A radially extending choke bore 55 hydraulically connects the servopressure chamber 50 with the blind hole bore 53 and with the upper section 56 of servopressure chamber 50. The stop ring flange 46 has a predetermined radial clearance 57 with respect to the outer circumference of ring flange 46. The prestress of the resilient compression spring 49, the pressure in chamber 50 in comparison to the low pressure of the fuel in the supply chamber 36 of injection pump 1 and the cross section area of the spool 39 are selected in such a way that, during pressurization of the servopressure chamber 50 with fluid pressure delivered by the pump 18, the spool 39 will be in the position illustrated in FIG. 3 in which it completely closes or blocks high pressure channel 44.

If the fluid control element of the solenoid valve 23 is shifted to the left, the pressure in servopressure chamber 50 diminishes and the compression spring 49 shifts the spool 39 with its piston rod portion 45 and its stop ring flange 46 upwardly through the spring stroke b to an intermediate or partially open fluid flow control position, at which point the stroke limit disk 47 abuts the abutment surface 51. If at this time a high pressure exists in channel 44 due to fuel delivery by the pump piston 27, this delivery pressure will act on the piston surface 41 and cause the spool 39 to shift upwardly through its stroke c to its open fluid flow control position wherein the top of flange 46 abuts an abutment surface 58 on the top wall of the chamber section 56 of the servopressure chamber 50 and the passage 44 is more fully open at the bore 50 than in the partially open position of the spool 39. At the same time, the high pressure of the fuel in the high pressure delivery chamber 35 is bypassed through the passage 44 to the supply chamber 36 and thence through the passage 42 to the return line 3. In the moment at which the spool 39 is raised out of its closed resting position by more than the overlap stroke a, the delivery of fuel by the pump piston 27 to the nozzle 9 is abruptly terminated.

Shortly before the end of the described upward movement of the spool 39 with its stop ring flange 46, a portion of the servopressure fluid in section 56 is conveyed through the funnel portion 54, the blind hole bore 53 and the choke bore 55, rather than through the clearance 57 thus providing a hydraulic dampener effective to dampen the final upward movement of the spool 39.

The termination of fuel delivery by the pump 1 is effected by the movement of the spool 39 of the delivery control device 16. The return or closing movement of the spool 39 does not interfere with the operation of the fuel pump. The closing movement does not require the precise timing that is required in the opening movement of the spool 39.

As previously mentioned, only one electrically operated solenoid valve 23 is needed to control all the delivery control devices 16 of all injection pumps of a multiple cylinder engine. The solenoid valve 23, which controls all the delivery control devices 16 through the fluid pressure circuit 19, changes the pressure in all the devices 16 simultaneously causing each spool 39 to shift axially from its closed position through its spring stroke b to a partially open position in which passage 44 is connected to the chamber 43, passage 42 and supply chamber 36. If the corresponding injection pump 1 is not delivering fuel, the pressure in high pressure pump chamber 35 cannot drop since the same pressure exists in the low pressure passage 42 and in high pressure passage 44. Only when the respective associated injection pump 1 is delivering fuel does the drop in fluid pressure cause a termination of the fuel delivery by injection pump 1, and only the spool 39 of the pump delivering fuel is moved through its piston stroke c.

The drop in fluid pressure from a high level to a low level is accomplished by shifting the solenoid valve 23 to the left, as viewed in FIG. 1, to its low pressure level position wherein the circuit 19 is opened to relief line 24, so that the servofluid can flow back to supply tank 20 by way of the low pressure relief valve 25. Thus, the movement of the solenoid valve to connect the servocircuit 19 to the relief line 24, and the resulting movement of the spool 39, terminates fuel delivery. Shifting the valve 23 to its high pressure level position, as shown in FIG. 1, causes a buildup of pressure in the servocircuit 19, and in the associated servopressure chamber 50 to shift the spool 39 to its illustrated closed position thereby restoring the fuel delivery capabilities of the associated injection pump 1. The respective closing process of the spool 39 must only be concluded early enough so that the high pressure passage 44 is closed by the spool 39 during the next initiation of fuel delivery by the diagonal leading edge 33 of pump piston 27 passing above the intake openings 34.

The solenoid valve 23 is controlled by the regulator 11. The use of only one solenoid valve 23 for a multiple cylinder engine means that during the chronological sequence of the switching process, the injection sequence of the engine and the differing line lengths from the solenoid valve 23 to the individual delivery control valves 16 must be taken into consideration. In addition, the engine speed and the upper dead center position must be fed to this regulator 11. Differing line distances from the solenoid valve 23 to the individual delivery control valves 16 could be compensated for by using individual lines of the same length from the solenoid valve 23 to the delivery control valves 16 in place of the loop circuit 19.

For optimum electronic regulation, the digitalized injection-begin and injection-end signals from the needle stroke monitor 10 are conveyed to the regulator 11 as feedback. Thus, a continuous theoretical/actual value comparison for injection time or injection termination is possible for every single injection. Deviations caused by hysteresis in the movement of the spool 39 and/or the valve 23, which are inherent in this type of mechanism, can thus be corrected easily.

Figure 4:
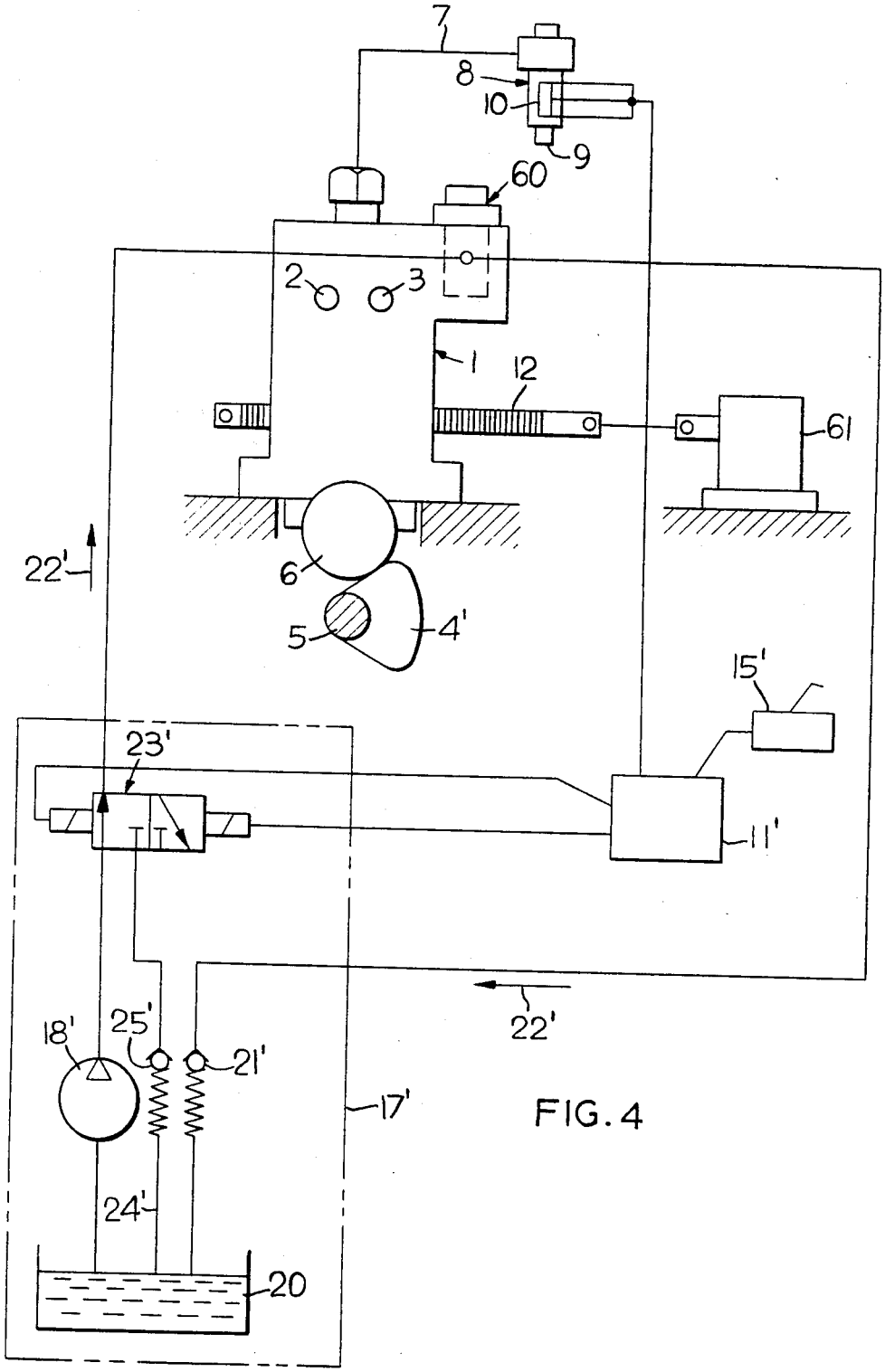
FIG. 4 is a schematic illustration showing an injection system, in which the injection pump is provided with a pilot injection valve.

In addition to or in place of the delivery control valve 16, a pilot injection valve 60 can also be provided which includes a slide valve for effecting pilot injection before the main injection. In FIG. 4, a pilot injection valve 60 is attached to the injection pump 1 without a delivery control valve 16. As can be seen in FIG. 2, both valves 16 and 60 can be used together on one injection pump. To the extent that the illustrations in FIGS. 1 and 4 agree, the same reference numbers are used and a new description is not needed. Features or components which are similar are designated by the same number but with a prime (') added.

A regulator 11' receives a signal which corresponds to the stroke of the nozzle needle in digitalized form from the needle stroke monitor 10 of the nozzle holder assembly 8; that is, the beginning and conclusion of the injection are both identified by monitoring the needle stroke. The drive cam 4' is designed in such a way that the injection pump effects a high pressure delivery of the fuel over the total time period which is covered by the pilot injection and main injection. The pilot injection valve 60 functions to interrupt the fuel injection during the interval between the end of pilot injection and the beginning of the main injection. When, as shown in FIG. 4, the pump 1 is provided with a pilot injection valve 60, but not with a delivery control valve 16, the control bar 12 is actuated by a regulating positioner 61, which determines the injection amount depending on the speed of the engine. Whenever valves 16 and 60 are both used on the pump, the control bar 12 is operated by the actuator 13, shown in FIG. 1, which is controlled by regulator 11, and the functions of regulator 11 and regulator 11' are combined.

A single hydraulic system 17' operates all the pilot injection valves 60 of all the injection pumps of an engine. The hydraulic system 17' is substantially the same as the hydraulic system 17 shown in FIG. 1.

Figure 5:
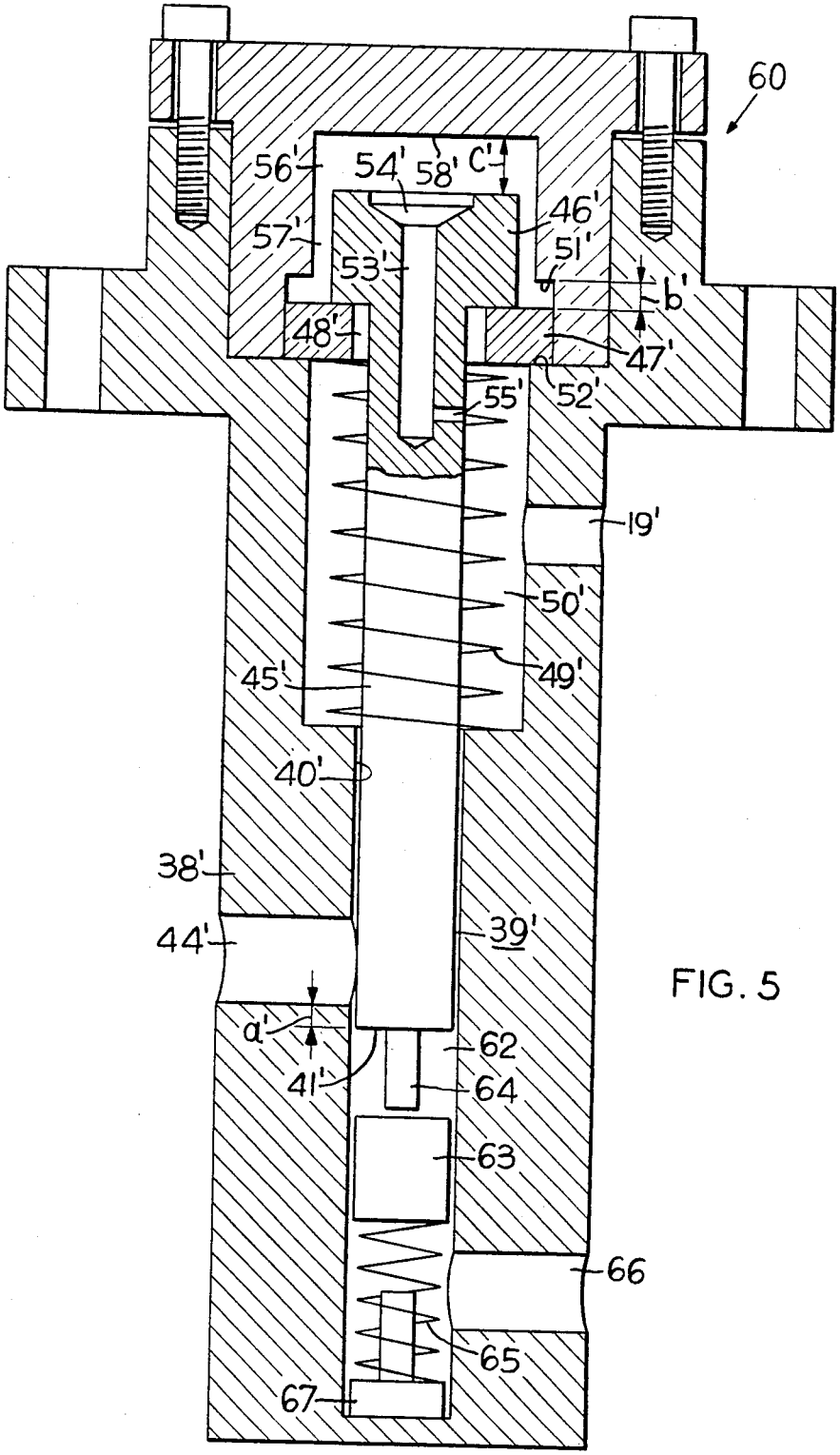
FIG. 5 is a vertical section through the pilot injection valve shown in FIG. 2.

The design of pilot injection valve 60 is identical to the part of the delivery control valve 16 in FIG. 3 from piston surface 41' to stroke stop 58'. Similar components shown in FIG. 5 are indicated with the same reference numbers as in FIG. 3 but with a prime (') added thereto.

Beneath the piston surface 41' of valve spool 39', an expansible equalizing chamber 62 is provided in the extended casing bore 40', in which an axially shiftable equalization piston 63 is disposed. A rod-shaped spacer 64 on the end of the spool 39' maintains the upper end of the equalization piston 63 a predetermined minimal distance from piston area 41'. The other axial end of the equalization piston 63 is biased axially upwardly toward said spool 39' by means of a compression spring 65 whose lower end abuts a stroke stop abutment 67 in the bottom of the casing bore 40'. A bleed passage 66 drains any fuel from the bore 40' that might pass around the alternate piston 63 and avoid a closed chamber condition at the bottom of the bore 40'. The abutment 67 with its rod-like extension limits the downward stroke of the equalization piston 63. The stroke stop abutment 67 together with the alternate piston 63 establishes the limit of the downward expansion of the equalizing chamber 62.

If the signal from regulator 11' causes the solenoid valve 23' to open, thereby causing the pressure in circuit 19' to drop as well as in servopressure chamber 50' of the pilot injection valve 60', the spool 39' is shifted upwardly by the force of the compression spring 49' through the spring stroke b'. As the spool 39 moves past the end of the overlap stroke a', the fuel which is being subjected to injection pressure flows from the high pressure pump chamber 35 through high pressure passage 44' into the equalization chamber 62 and the equalization piston 63 is shifted downwardly against the force of compression spring 65 to abut the stroke stop 67. At the same time, the increased pressure in the equalization chamber causes the piston 39' to shift upward through the stroke c to abut against the stroke stop 58' in the dampened manner previously described. The total of the upward shifting of the spool 39' and the downward shifting of the equalization piston 63 determines the expanded volume of equalization chamber 62 which accepts a predetermined amount of fuel from the high pressure pump chamber 35. When the fuel subjected to high pressure begins to flow from the high pressure pump chamber 35 to the equalizing chamber 62, the pilot injection to the injection nozzle 9 ends. When the equalizing chamber is fully expanded, the high pressure delivery of fuel to the high pressure line 7, and thus to the injection nozzle 9, resumes and the main injection begins.

After the main injection has ended, the pressure drops in high pressure chamber 35, and the equalization piston 63 returns to an equilibrium position under the pressure of compression spring 65 and the predetermined amount of fuel is returned to the high pressure pump chamber 35. If the regulator 11' causes the solenoid valve 23' of the servocircuit to shift again to its illustrated position, thus raising the fluid pressure in the loop circuit 19' and in the servopressure chamber 50' to a predetermined high level, the piston 39' is again shifted to its closed position to prevent passage of fuel through the high pressure passage 44' and simultaneously a corresponding amount of fuel is returned from equalizing chamber 62 to the high pressure pump chamber 35.

In the illustrated embodiment of the invention, the expanded volume of the equalizing chamber 62 is a fixed amount and the interval between the end of the pilot injection and the beginning of the main injection cannot be modified. However, a change in the interruption can be achieved by making the stroke stop 67 axially adjustable.

Since only one solenoid valve 23' is provided for all injection pumps 1 of all cylinders of the multiple cylinder engine for the purpose of regulating the servopressure, there are additional empty strokes of the spool 39' through the spring stroke b' at each injection pump 1. In order to prevent expansion of the equalizing chamber 62 during these empty strokes, the equalizing piston 63 is forced to follow the spool 39' by the force exerted by the compression spring 65. During an empty stroke of the spool 39', the spring 65 maintains the equalization piston 63 in abutment with the spacer 64 and the quantity of fuel within equalizing chamber 62 neither increases nor decreases. When both a delivery control valve 16 and a pilot injection valve 60 are used in a pump, the functions of regulators 11 and 11' could be combined and the solenoid valves 23, 23' of the servopressure systems 17, 17' would be independently controlled by such a regulator.

The end of the main injection and pilot injection function would be independently controlled and switching means could be provided at the regulator or operator's control to switch off pilot injection.

We claim:

1. In a fuel injection system for a diesel engine of the type having an injection pump for each of a plurality of combustion cylinders, each pump having a housing containing a low pressure fuel supply chamber and a high pressure pump chamber in which fuel is subjected to a fuel injection pressure by a reciprocating pump piston whereby fuel is delivered to an injection nozzle, the combination comprising:

an arrangement for modifying the fuel delivery of each of said injection pumps including a delivery control valve in each pump including wall means defining a spool bore, an axially shiftable delivery control spool in sealing relation with said bore, the end surface of one end of said delivery control spool and said spool bore defining a low pressure chamber, a low pressure passage connecting said low pressure chamver in fluid communication with said fuel supply chamber, wall means defining a servopressure chamber at the other end of said delivery control spool, a high pressure passage in said pump connecting said high pressure pump chamber to said spool bore at a point spaced a first predetermined axial distance from the connection of said low pressure passage to said low pressure chamber, said delivery control spool being axially shiftable between a first fluid flow control position in which it closes said high pressure passage at said spool bore and a second fluid flow control position in which said high pressure passage is partially open at said piston bore whereby it is in fluid communication with said low pressure chamber, biasing means axially urging said delivery control spool to its second axial position, and a pressure fluid supply system independent of fuel supplied to said supply chamber operable to supply pressure fluid to said servopressure chamber including a solenoid valve having a first fluid flow control position in which a first level of pressure is effected in said servopressure chamber causing said delivery control spool to be in its first position and having a second fluid flow control position in which a second level of pressure is effected in said servopressure chamber permitting said biasing means to cause said delivery control spool to be in its second position of adjustment whereby actuation of said solenoid valve effects termination of fuel delivery of said pump.

2. The injection system of claim 1 wherein said biasing means includes a resilient coil compression spring surrounding said delivery control spool and operatively interposed between the latter and said wall means defining said servopressure chamber so as to resiliently bias said delivery control spool to its said second axial position.

3. The injection system of claim 2 wherein said spring has a one-way connection with said delivery control spool and wherein the latter is shiftable to a third axial position of adjustment a greater distance from said first axial position than said second axial position is spaced from said first axial position whereby in said third axial position said high pressure passage is more fully open at said piston bore.

4. The injection system of claim 3 wherein said delivery control spool includes a flange portion at said other end thereof and further comprising a disk with a central opening through which said spool extends, said spring being in axial thrust transmitting engagement with one axial side of said disk and the other side of said disk being in axial thrust transmitting engagement with one axial side of said disk and the other side of said disk being in axial thrust transmitting engagement with said flange, said wall means defining said servopressure chamber presenting axially spaced abutment surfaces in confronting abuttable relation to opposite sides of said disk so as to permit a spring biased stroke of said spool between its first and second positions, said wall means of said servopressure chamber further including a stroke stop abutment surface in confronting relation to the upper end of said spool, said spool being shiftable by fuel injection pressure in said low pressure chamber to said third position of adjustment in which said spool abuts said stroke stop abutment.

5. The injection system of claim 4 and further comprising a hydraulic dampener in said servopressure chamber operatively associated with said spool so as to cushion said spool as it abuts said stroke stop abutment.

6. The fuel injection pump of claim 1 wherein a single fluid supply system supplies pressure fluid to the servopressure chambers of all said pumps of said engine and wherein a single solenoid valve controls actuation of all of said delivery control spools of said pumps.

7. The fuel injection system of claim 1 and further comprising a hydraulic dampener in said servopressure chamber and operatively associated with said spool so as to cushion said spool as it abuts said stroke stop abutment.

8. The fuel injection system of claim 1 wherein said spool is shiftable to a third position of adjustment in which said high pressure passage is fully open at said bore when fuel in said low pressure chamber is subjected to a fuel injection pressure.

9. In a fuel injection system for a diesel engine of the type having an injection pump for each of a plurality of combustion cylinders, each pump having a housing containing a low pressure fuel supply chamber and a high pressure pump chamber in which fuel is subjected to fuel injection pressure by a reciprocating pump piston whereby fuel is delivered to an injection nozzle, the combination comprising:

an arrangement for modifying the fuel delivery of each of said injection pumps including a pilot injection valve in each pump including wall means defining a spool bore, an axially shiftable spool in sealing relation with said bore and presenting an end surface at one end thereof, an axially shiftable equalizing piston in sealing relation with said bore, said bore, said end surface of said spool and one axial end of said equalization piston defining an equalization chamber, stop means limiting axial shifting movement of said equalizing piston in said bore in a direction away from said spool, means resiliently biasing said equalizing piston in an axial direction toward said spool from a retracted position abutting said stop means in which said equalization chamber is expanded to an extended position in which said equalization chamber is reduced, a high pressure passage extending between and interconnecting said high pressure chamber of said pump and said bore, said spool having a first position in which it blocks said high pressure passage at said bore and a second axially shifted position wherein said high pressure passage is at least partially open at said bore whereby said equalization chamber is in fluid communication with said high pressure chamber of said pump, resilient means biasing said spool from said first position toward said second position, wall means defining a servopressure chamber at the other end of said spool, and a pressure fluid supply means supplying pressure fluid to said servopressure chamber including an electrically operated control valve having a first control position in which a first level of fluid pressure is effected in said servopressure chamber and a second control position in which a second level of fluid pressure is effected in said servopressure chamber, said spool being hydraulically shifted from one of its positions to the other of its positions when said control valve is shifted to its second position whereby during initial delivery of fuel at injection pressure to said nozzle said high pressure chamber is connected to said equalization chamber which causes said equalizing piston to move against its biasing means toward its retracted position whereby said equalization chamber expands as it admits pressurized fuel from said high pressure chamber thereby causing a sufficient pressure drop in said high pressure chamber to terminate pilot injection, said injection pressure being reestablished in said high pressure chamber by said pump piston upon said equalization piston having shifted to its retracted position.

10. The injection system of claim 9 wherein said resilient means biasing said spool from said first position toward said second position includes a coil compression spring surrounding said spool and disposed within said servopressure chamber.

11. The injection system of claim 10 and further comprising a disk within said servopressure chamber with a central opening through which said spool extends and axial abutment means on said spool in axially abuttable relation with one axial side of said disk, one axial end of said spring engaging the other axial side of said disk and a pair of confronting abutment surfaces within said servopressure on axially opposite sides of said disk and spaced from each other a predetermined distance which exceeds the axial thickness of said disk by a linear dimension equaling the distance said spool moves between its first and second position.

12. The injection system of claim 11 wherein said spool has a third axially shifted position wherein said high pressure passage is more completely open at said bore than it is in the second position of said spool.

13. The injection system of claim 12 wherein said spool is shifted to said third position by the pressure of the fuel in said equalization chamber being at an injection pressure.

14. The injection system of claim 9 wherein said spool has a third axially shifted position wherein said high pressure passage is more completely open at said bore than it is in the second position.

15. The injection system of claim 14 and further comprising a hydraulic dampener in said servopressure chamber operatively associated with said spool so as to cushion said spool as it approaches its third position.

16. The injection system of claim 9 wherein said pressure fluid supply system supplies pressure fluid to the servopressure chambers of all said injection pumps of said engine and wherein a single solenoid valve in said fluid supply system is operable to effect simultaneous change of pressure in said servopressure chambers and corresponding axial shifting of said spools from their first position to their second position.

17. The injection system of claim 9 wherein said means resiliently biasing said equalization piston is a coil compression spring abutting the other axial end of said equalization piston.

18. In a fuel injection system for a diesel engine of the type having an injection pump for each of a plurality of combustion cylinders, each pump having a housing containing a low pressure fuel supply chamber and a high pressure pump chamber in which fuel is subjected to a fuel injection pressure by a reciprocating pump piston whereby fuel is delivered to an injection nozzle, the combination comprising:

an arrangement for modifying the fuel delivery of each of said injection pumps including a delivery control valve in each pump including wall means defining a spool bore, an axially shiftable delivery control spool in sealing relation with said bore, the end surface of one end of said delivery control spool and said spool bore defining a low pressure chamber, a low pressure passage connecting said low pressure chamber in fluid communication with said fuel supply chamber, wall means defining a servopressure chamber at the other end of said delivery control spool, a high pressure passage in said pump connecting said high pressure pump chamber to said spool bore at a point spaced a first predetermined axial distance from the connection of said low pressure passage to said low pressure chamber, said delivery control spool being axially shiftable between a first fluid flow control position in which it closes said high pressure passage at said spool bore and a second fluid flow control position in which said high pressure passage is partially open at said piston bore whereby it is in fluid communication with said low pressure passage, biasing means axially urging said delivery control spool to its second axial position, and a pressure fluid supply system supplying pressure fluid to said servopressure chamber including a solenoid valve having a first fluid flow control position in which a first level of pressure is effected in said servopressure chamber causing said delivery control spool to be in its first position and having a second fluid flow control position in which a second level of pressure is effected in said servopressure chamber permitting said biasing means to cause said delivery control spool to be in its second position of adjustment whereby actuation of said solenoid valve effects termination of fuel delivery of said pump, and a pilot injection valve in each pump including wall means defining a spool bore, an axially shiftable spool in sealing relation with said bore and presenting an end surface at one end thereof, an axially shiftable equalizing piston in sealing relation with said bore, stop means limiting axial shifting movement of said equalizing piston in said bore in a direction away from said spool, said bore, said end surface of said spool and one axial end of said equalization piston defining an equalization chamber, means resiliently biasing said equalizing piston in an axial direction toward said spool from a retracted position abutting said stop means in which said equalization chamber is enlarged and an extended position in which said equalization chamber is reduced, a high pressure passage extending between and interconnecting said high pressure chamber of said pump and said bore, said spool having a first position in which it blocks said high pressure passage at said bore and a second axially shifted position wherein said high pressure passage is at least partially open at said bore whereby said equalization chamber is in fluid communication with said high pressure chamber of said pump, resilient means biasing said spool from said first position toward said second position, wall means defining a servopressure chamber at the other end of said spool; and a pressure fluid supply means supplying pressure fluid to said servopressure chamber including an electrically operated control valve having a first control position in which a first level of fluid pressure is effected in said servopressure chamber and a second control position in which a second level of fluid pressure is effected in said servopressure chamber, said spool being hydraulically shifted from one of its positions to the other of its positions when said control valve is shifted to its second position whereby during initial delivery of fuel at injection pressure to said nozzle said high pressure chamber is connected to said equalization chamber which causes said equalizing piston to move against its biasing means toward its retracted position whereby said equalization chamber expands as it admits pressurized fuel from said high pressure chamber thereby causing a sufficient pressure drop in said high pressure chamber to terminate pilot injection, said injection pressure being reestablished in said high pressure chamber by said pump piston upon said equalizing piston having shifted to its retracted position.

* * * * *